US005728008A

United States Patent [19]

Howard

[11] Patent Number: 5,728,008

[45] Date of Patent: Mar. 17, 1998

[54] BALL STRIKING DEVICE WITH MEANS OF IMPARTING ENHANCED FORWARD MOMENTUM TO THE BALL

[75] Inventor: Herman S. Howard, Hallandale, Fla.

[73] Assignee: Media Group, Stamford, Conn.

[21] Appl. No.: 798,487

[22] Filed: Feb. 10, 1997

[51] Int. Cl.[6] ..... A63B 53/02

[52] U.S. Cl. ..... 473/308; 473/310; 473/409; 473/521; 473/562

[58] Field of Search ..... 473/305–315, 473/316, 324, 332, 219, 226, 233, 256, 409, 520, 562, 521

[56] References Cited

U.S. PATENT DOCUMENTS

| | | | |
|---|---|---|---|
| 695,579 | 3/1902 | Parmele | 473/311 |
| 826,102 | 7/1906 | Hersey | 473/308 |
| 3,572,709 | 3/1971 | Risher | 473/308 |
| 5,184,819 | 2/1993 | Desbiolles | 473/312 |
| 5,226,652 | 7/1993 | Sato | 473/312 |
| 5,277,423 | 1/1994 | Artus | 473/310 |
| 5,282,618 | 2/1994 | Hong | 473/523 |
| 5,362,048 | 11/1994 | Haste | 473/313 |

FOREIGN PATENT DOCUMENTS

| | | | |
|---|---|---|---|
| 403286787 | 12/1991 | Japan | 273/80.2 |
| 3489 | of 1910 | United Kingdom | 273/80.3 |
| 1819 | of 1915 | United Kingdom | 273/80.3 |

*Primary Examiner*—Sebastiano Passaniti
*Attorney, Agent, or Firm*—Evelyn M. Sommer

[57] ABSTRACT

This invention relates to an improved ball striking device, such as a golf club, hockey stick, or tennis racket, in which a greater striking power is imparted to the ball, puck or the like by inserting a connecting elastomeric member between the head or striking portion and the shaft portion of the device. The inherent resilient characteristics of the member allows an enhancement of the forward motion imparted to the ball.

20 Claims, 3 Drawing Sheets

BALL STRIKING DEVICE WITH MEANS OF IMPARTING ENHANCED FORWARD MOMENTUM TO THE BALL

BACKGROUND OF THE INVENTION

This invention relates to improved ball striking devices such as clubs or rackets used in common popular sports, including but not limited to, golf, tennis, or hockey. In particular, this invention makes use of the inherent resilience and viscoelasticity of elastomers in order to improve the performance characteristics of such clubs or rackets by enhancing the momentum transfer to the ball at the point of contact.

FIELD OF THE INVENTION

Ball striking devices such as golf clubs and tennis rackets generally comprise (1) a shaft, (2) a head which is attached to one end of the shaft, and (3) a grip which is located at the other end of the shaft. The head includes a ball striking surface.

Attempts have been made in the past to improve the dynamic characteristics of such ball striking devices. In the field of tennis racket design, for example, U.S. Pat. No. RE 33,011 discloses a tennis racket with a string protection system involving elastomer inserts which are molded into the head portion of composite material rackets. U.S. Pat. No. 5,211,398 discloses a tennis racket frame whose thickness varies in such a way as to make the natural frequency of the racket frame closer to the excitation frequency of the balls.

Several patents disclose means for increasing the momentum transfer imparted to a golf ball when struck by the golf club. Such enhanced momentum transfer is achieved mostly by redesigning the shaft or the head portion of the club, or both. U.S. Pat. No. 4,319,750 discloses, for example, a composite golf shaft having a flex zone along the shaft. The shape of the shaft is modified to position the flex zone at a predetermined point along the shaft. In U.S. Pat. No. 5,308,062 a central, flexible portion is included in the shaft, and the diameter of the shaft is varied in such a way that the wall thickness is at a maximum at the tip end of the shaft adjacent to the head, so that more weight is produced at the head end of the shaft.

Other patents disclose increasing the strength and hardness of the golf club head by use of inserts of various configurations and materials. U.S. Pat. No. 4,591,160 discloses a golf club head which comprises a core body made of synthetic or natural rubber and an outer shell made of polymeric thermoplastic material. U.S. Pat. No. 5,306,008 discloses a high moment of inertia interconnect in the club head. U.S. Pat. No. 4,655,458 provides within the club head a weighting chamber filled with an appropriate amount of liquid-like material which moves within the weighting chamber in the direction of swing.

Although some patents disclose elastomeric material in parts of the area between the shaft and the head of a golf club, no reference discloses an insert member which is made entirely from elastomeric material and which is the sole insert between the shaft and the head, replacing a part of the shaft. U.S. Pat. No. 5,505,454 discloses an elongated tubular elastomeric member which is coaxially affixed to the lower portion of the shaft, rather than being inserted between the shaft and the head. Also, U.S. Pat. No. 3,572,709 discloses an outer sleeve made of elastomeric material which surrounds and encompasses the inner sleeve of the shaft at the junction between the shaft and the head. Neither reference suggests the insertion of an elastomeric member between the head and the proximal end of the shaft to replace a portion of the shaft.

In sum, although there exists a long standing need to enhance the forward momentum imparted by ball striking devices, there has been no suggestion in the prior art for inserting an elastomeric member between the shaft and the striking surface of a club or racket in order to increase the rebound or momentum transfer to the ball, as disclosed in the present invention.

SUMMARY OF THE INVENTION

A primary objective of the present invention is to provide an improved momentum transfer or rebound from the striking surface to the associated ball in ball striking sports such as golf, hockey or tennis. A related objective of this invention is to provide such improved momentum transfer without requiring a corresponding increase in the weight or size of the striking surface, or an increased physical effort on the part of the player. Still another related objective of this invention is to provide striking devices having improved striking characteristics for a given design and material of the shaft, or of the striking surface, such as the string net of a tennis racket. Finally, a related objective of this invention is to provide a training aid which will facilitate the learning process for beginners in the pertinent sport as they endeavor to develop a proper swing and strike.

The above mentioned objectives are attained by this invention which discloses an elastomeric interconnecting member, which is inserted at or closely adjacent to the junction between the shaft and the head of the club or racket in such a manner as to operatively connect the head to the proximal or head end of the shaft. The insert member replaces a portion of the shaft. Because of the elastic resilience of the insert member, the deformation energy stored in the member when the club or racket is swung through an arc is released in the form of added mechanical work before the ball is hit, thereby increasing the momentum transfer to the ball. Also, the vibrational shock waves which are imparted to the shaft when the ball is hit, and which hinder the efforts of the player, are reduced, because of the viscoelastic properties of the elastomeric member.

The insert can be made of a natural or conventional synthetic rubber, or a synthetic elastomer (both rubber materials and synthetic elastomers will hereinafter be called elastomers). Elastomers as used herein are any polymers which possess elastic properties, and which preferably can be stretched repeatedly at room temperature to at least twice their original length, and upon immediate release of the stress will return with force to its approximate original length. Any conventional elastomer, such as butadiene-acrylonitrile copolymer, choloroprene polymer, ethylene propylene copolymer, isobutylene-isoprene, polybutadiene, natural polyisoprene, synthetic polyisoprene, styrene-butadiene copolymer may be used, all of which may include fillers, such as silica, carbon black, and cellulose.

In the present invention, a solid, substantially cylindrical elastomeric member is inserted between the head and the proximal or connection end of the shaft. The elastomeric insert member is compressed and deformed in response to the stress applied to the shaft when a centrifugal force is generated as the device is swung through an arc before the ball is struck. It is well known that when an elastic substance is deformed, a corresponding restoring force is set up within the body. Such an elastic restoring force is directly proportional to the strain to which the body is subjected, according to Hooke's law.

Another salient mechanical property of elastomers is their resilience. The resilience of a body measures the extent to which energy may be stored in it by elastic deformation, so that the stored energy may be released in the form of mechanical work when the force causing the elastic deformation is removed. Resilience is an intrinsic property of a material within its elastic limit, each material having a characteristic modulus of resilience which measures the maximum energy storage in a unit volume of the material.

Because of the elastic resilience of the insert member, the energy stored by the member while it is being deformed during the swinging of the club or racket is released as an additional force which adds to the force exerted by the player. In this manner, the interconnecting member causes a greater "snap" or momentum transfer to be imparted when the device hits the ball, as compared with ordinary shaft—head assemblies with no such interconnecting members. The hardness of the elastomeric material should preferably vary between about 30 to about 85 durometers.

Elastomers also have viscoelastic properties, which cause them to reduce the frequency of the vibrations imparted to the shaft when the ball is hit. Viscoelastic materials, which have an intrinsic damping coefficient, exhibit a delayed elastic response to stress, in addition to instantaneous elasticity, and lower the stress-generated vibration amplitudes by degrading part of the energy of deformation into heat. The use of vibration damping handles made of elastomeric material is well known in applications such as power tools, hand tools, and athletic equipment.

The elastomeric insert disclosed in the present invention reduces the amplitudes of the vibrational shock waves which travel up the shaft and are transmitted to the player just after the ball is hit. In this way, the elastomeric insert reduces the player's fatigue and energy loss, and aids the player in his efforts to develop a more efficient swing.

By introducing elastomers of different moduli of resilience and damping coefficients, the degree of resilience and viscoelasticity of the elastomeric insert can be varied to adjust to the different preferences and skill levels of the individual players. For skilled players who desire a maximum transfer of momentum to the ball, the preferred class of elastomers would be those with the largest modulus of resilience, such as neoprene, ethylene propylene, chlorosulfonated polyethylene, and natural rubber.

BRIEF DESCRIPTION OF THE DRAWING

The present invention will be understood and appreciated more fully from the following detailed description, taken in conjunction with the accompanying drawings in which.

DETAILED DESCRIPTION OF THE PREFERRED EMBODIMENTS

By way of example, the present invention is illustrated in terms of the possible manner of inserting the elastomeric member between the striking surface and the shaft. The following examples are provided for the purpose of aiding in explaining the present invention. The invention's applications should not be limited to the applications described herein.

Figure 1:
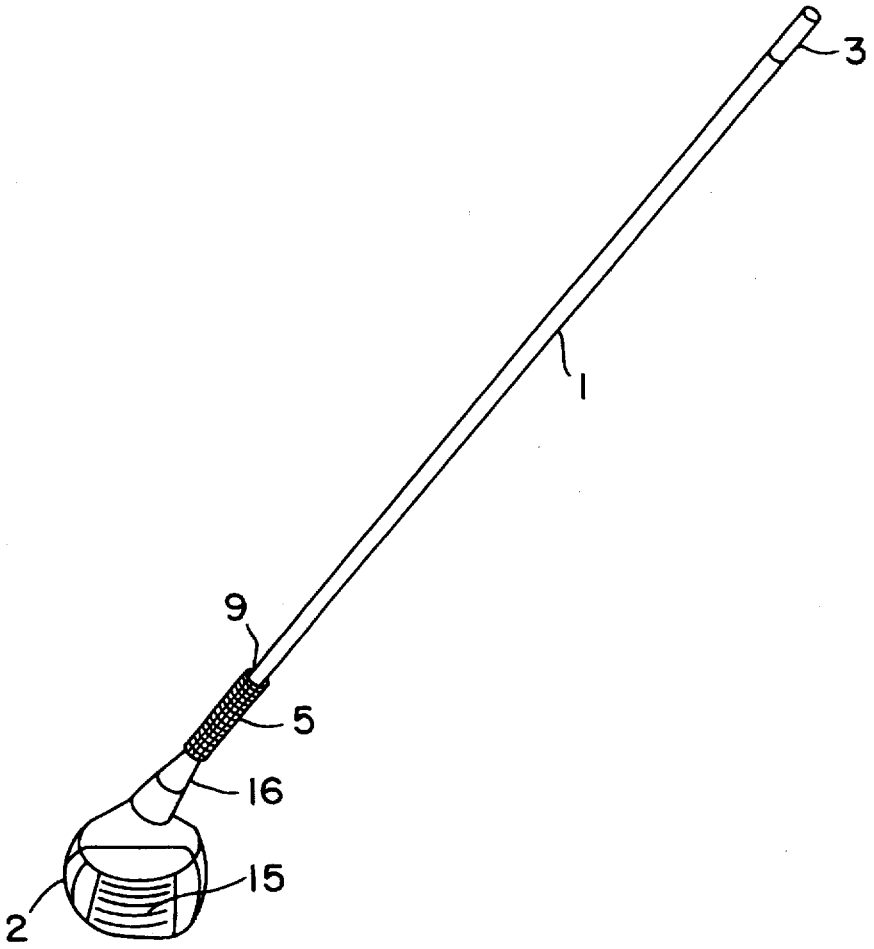
FIG. 1 is a plan view of an improved golf club according to the present invention.

FIG. 1 shows an improved golf club according to the present invention, comprising a shaft 1 which terminates at its distal end into a grip 3 and which is connected by an elastomeric insert member 5 at its proximal end 9 to a head 2. The head comprises a ball striking surface 15, and a hosel 16.

Figure 2:
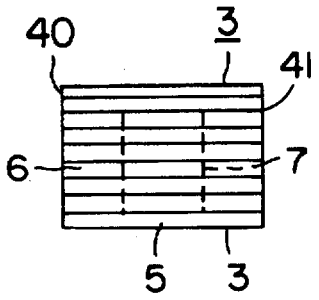
FIG. 2 is a side view of the elastomeric member which joins the shaft to the head of the device.
Figure 3:
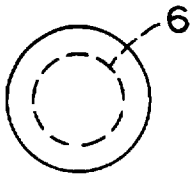
FIG. 3 is a top view of the elastomeric member, containing a concave recess.

The elastomeric insert member 5 having a cylindrical shape and being of solid construction is shown in FIG. 2. Openings or concave recesses 6 and 7 are provided at the first end 40 and the second end 41 of the insert member 5.

Figure 4:
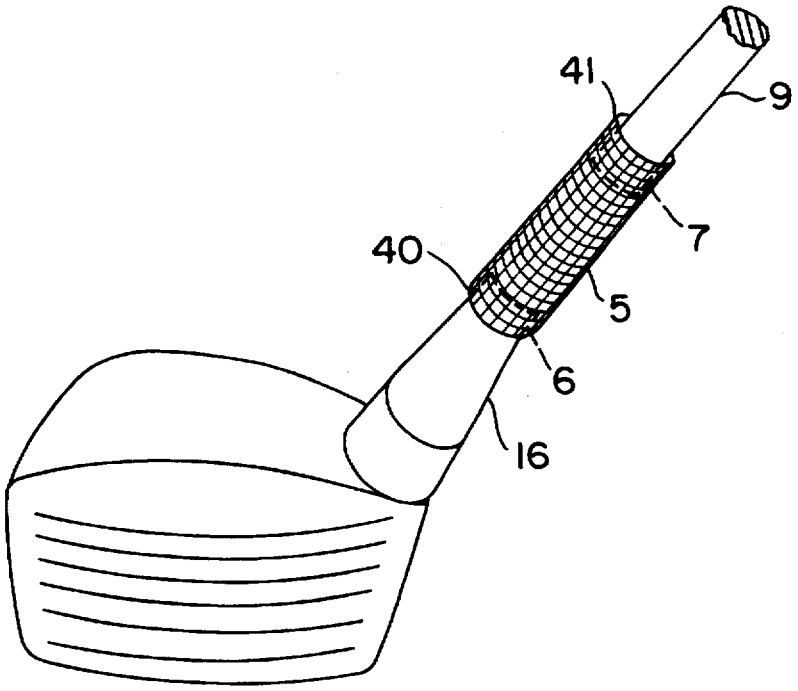
FIG. 4 is a more detailed view of the junction between the golf club shaft and the golf club, showing how the elastomeric member is affixed between the shaft and the head in one embodiment of the present invention.

As can be seen from FIG. 4, an elastomeric member 5 is attached between the hosel 16 of the head and the proximal end 9 of the shaft. Openings or concave recesses 6 and 7 are provided at both ends of the cylindrical insert member. The size of the openings are such that they fit tightly over the hosel 16 of the head and the proximal end 9 of the shaft. In a preferred embodiment, there should be a distance of at least two to five inches between one end 40 of the insert member to the other end 41. The elastomeric member is firmly secured in place by means of a suitable adhesive, for example an epoxy cement or other bonding means.

Figure 5:
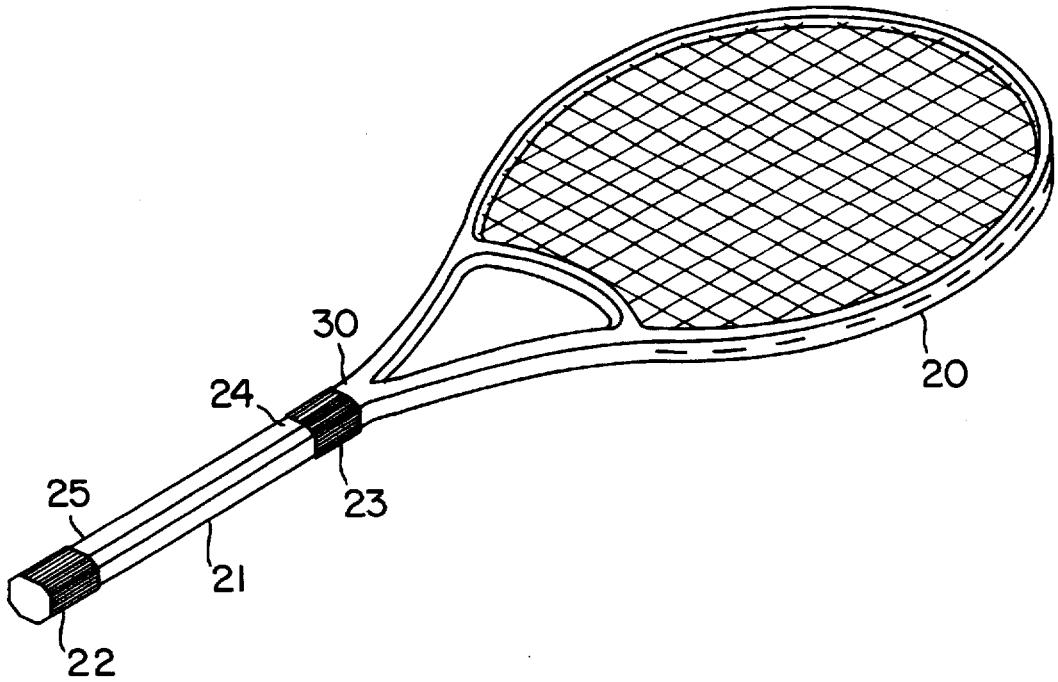
FIG. 5 shows an improved tennis racket according to the present invention.

A tennis racket constructed in accordance with the present invention is shown in FIG. 5, comprising a frame 20, a shaft 21, a grip 22, and a cylindrical elastomeric insert 23. The frame 20 has a protruding end 30. The shaft 21 has a proximal end 24 and a distal end 25. The elastomeric insert joins the frame at its end 30 with end 24 of the shaft.

Figure 6:
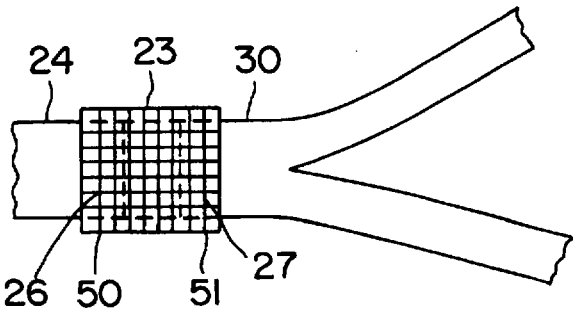
FIG. 6 is a more detailed view of the junction between the tennis racket frame and the shaft, showing how the elastomeric member is affixed between the shaft and the frame in one embodiment of the present invention.

FIG. 6 is a more detailed view of the junction between the tennis racket frame and the shaft and illustrates how the elastomeric member is secured to the shaft and the frame. Openings or concave recesses 26 and 27 are provided at both ends 50 and 51 of the insert member 23 so as to fit snugly over the protruding end 30 of the head and the proximal end 24 of the shaft of the racket. In a preferred embodiment, there should be a distance of at least one to three inches between one end 50 of the insert member to the other end 51. The elastomeric member is firmly affixed by means of an adhesive, such as epoxy cement, or other bonding means.

The above embodiments are provided only for the purposes of explaining specific applications of the present invention, and it will be appreciated by those skilled in the art that the applicant's invention is not limited to what has been particularly shown and described hereinabove. For example, for golf clubs an elastomeric member can be used which has one flat end a second end having a concave recess, whereby the flat end is inserted into a hollow hosel in the golf club head and secured by means of an adhesive. Also, elastomeric members can be inserted according to the manner disclosed in the present invention in other ball striking devices, such as hockey sticks, ping-pong rackets, racquetball rackets, squash rackets, and badminton rackets. Further, it will be apparent to those skilled in the art that various modifications and variations could be made in the present invention without departing from the scope or spirit of the invention.

What is claimed is:

1. An improved ball striking device, which comprises:

a shaft having a proximal end and a distal end;

a head having a ball striking surface for coupling to the proximal end of said shaft; and an intermediate insert member positioned between and coupling said proximal end of said shaft and said head, said insert member having a first end and a second end, said second end being connected to said distal end of said shaft and said first end being connected to said head, said insert member being made of elastomeric material.

2. The ball striking device of claim 1, wherein said device is a golf club.

3. The device of claim 2, wherein said insert member is solid and cylindrical in shape, and wherein said insert member is formed with a concave recess at each end thereof.

4. The device of claim 2, wherein said insert member is connected to said head and to said proximal end of said shaft by means of an adhesive.

5. The device of claim 3, wherein, said head includes a hosel; said first end of said insert member being inserted over said hosel and attached thereto by means of an adhesive, said second end of said insert member being attached by means of an adhesive to the proximal end of said shaft.

6. The device of claim 2, wherein said elastomeric material is butadiene-acrylonitrile copolymer, choloroprene polymer, ethylene propylene copolymer, isobutylene-isoprene, polybutadiene, natural polyisoprene, synthetic polyisoprene, styrene-butadiene copolymer, neoprene, or natural rubber.

7. The device of claim 2 wherein said elastomeric material has a hardness between about 30 and about 85 durometers.

8. The device of claim 2 wherein said insert member has a length between two and five inches.

9. The device of claim 1, wherein said device is a tennis racket.

10. The device of claim 9, wherein said insert member is solid and cylindrical in shape, wherein said insert member is formed with a concave recess at each end thereof.

11. The device of claim 9, wherein said insert member is connected at the opposite ends thereof to said head and to said proximal end of said shaft by means of an adhesive.

12. The device of claim 9, wherein said elastomeric material is butadiene-acrylonitrile copolymer, choloroprene polymer, ethylene propylene copolymer, isobutylene-isoprene, polybutadiene, natural polyisoprene, synthetic polyisoprene, styrene-butadiene copolymer, neoprene, or natural rubber.

13. The device of claim 9, wherein said elastomeric material has a hardness between about 30 and about 85 durometers.

14. The device of claim 9, wherein said insert member has a length between one inch and three inches.

15. The device of claim 1, wherein said device is a hockey stick.

16. The device of claim 1, wherein said device is a ping-pong racket.

17. The device of claim 1, wherein said device is a racquetball racket.

18. The device of claim 1, wherein said device is a squash racket.

19. The device of claim 1, wherein said device is a badminton racket.

20. A method of enhancing the forward motion imparted to a ball by a ball striking device comprised of a shaft having a proximal end and a distal end and a head having a ball striking surface for coupling to the proximal end of said shaft, comprising:

inserting an intermediate insert member positioned between and coupling said proximal end of said shaft and said head, said insert member having a first end and a second end, said second end being connected to said distal end of said shaft and said first end being connected to said head, said insert member being made of an elastomeric material.

* * * * *